United States Patent [19]

Cherney et al.

[11] 4,012,102

[45] Mar. 15, 1977

[54] SOLDERLESS ELECTRICAL CONTACT

[75] Inventors: Thomas M. Cherney, Minneapolis; Robert S. Dodsworth, North St. Paul, both of Minn.

[73] Assignee: Minnesota Mining and Manufacturing Company, St. Paul, Minn.

[22] Filed: May 26, 1976

[21] Appl. No.: 689,977

[52] U.S. Cl. ..... 339/97 P

[51] Int. Cl.[2] ..... H01R 9/08

[58] Field of Search ..... 339/97–99

[56] References Cited

UNITED STATES PATENTS

| | | | |
|---|---|---|---|
| 3,234,498 | 2/1966 | Logan | 339/97 P |
| 3,718,888 | 2/1973 | Pasternak | 339/98 |

FOREIGN PATENTS OR APPLICATIONS

| | | | |
|---|---|---|---|
| 2,438,178 | 3/1975 | Germany | 339/97 R |

*Primary Examiner*—Joseph H. McGlynn
*Attorney, Agent, or Firm*—Cruzan Alexander; Donald M. Sell; Terryl K. Qualey

[57] ABSTRACT

A solderless electrical contact comprising a thin resilient flat plate having at least one pair of parallel extended legs defining an open-ended wire-receiving slot, and a method for making the contact. The legs of the contact are similarly coined along the wire-receiving slot, the coining being progressively deeper into the thickness of the flat plate from the open end of the slot toward the closed end thereof to taper the slot from a width adjacent the open end of the slot of less than the thickness of the flat plate to a lesser width adjacent the closed end of the slot. The contact permits effective electrical connection to two small diameter insulated conductors pressed into the wire-receiving slot.

8 Claims, 5 Drawing Figures

SOLDERLESS ELECTRICAL CONTACT

FIELD OF THE INVENTION

The present invention relates to solderless wire connectors for making electrical connections to insulated wires.

BACKGROUND OF THE INVENTION

Solderless wire connectors utilizing slotted flat plate contact members like that of the present invention have previously been described, for example, in Levin et al., U.S. Pat. No. 3,012,219 and Elm, U.S. Pat. Nos. 3,258,733 and 3,388,370. These connectors provide excellent electrical contact with insulated wires of appropriate diameter when only one wire is placed in each slot of the flat plate. Usually this presents no problem since the flat plate contact members are provided with multiple slots for multiple wires to be connected together. However, some applications, such as the wiring of miniaturized electronic circuits, do not permit the space for multi-slotted contact members.

Multiple wires can only be reliably connected in a single slot of a flat plate contact member if the slot tapers from its open end toward its closed end. Such tapers can be effectively stamped in the flat plate when the slots are for relatively large diameter wire, and such taper slots have been stamped to make positive connection even when only a single wire is to be connected in one slot, as shown in U.S. Pat. Nos. 3,511,921; 3,718,888 and 3,899,236. Flat plate contact slots have also been made to taper by stamping of a parallel edge slot and then twisting the legs of the contact, as illustrated in U.S. Pat. No. 3,820,058.

Stamping of slots in flat plate connectors is, as a rule of thumb, limited to a slot width no less than the thickness of the flat plate material. See, for example, U.S. Pat. No. 3,824,527 at Column 3, lines 33 through 52. It has also been found that it is generally impractical to make free-standing flat plate connectors of a thickness less than 0.010 inch because if a lesser thickness is used the legs of the contact tend to distort out of the plane of the flat plate and not make effective electrical contact with the wire. However, in wiring miniaturized electronic circuitry it is desirable to connect wires of 30 AWG and smaller having a diameter of 0.010 inch and less, thus requiring a slot with less than that readily available by stamping. This problem of stamping narrow slots becomes even more severe if it is desired to taper the slot. The prior art has not provided any narrow width tapered slot or any other effective means for connecting a plurality of small diameter insulated wires with a single slot flat plate contact.

SUMMARY OF THE INVENTION

The present invention provides a slotted solderless electrical contact for making effective electrical connection to two small diameter insulated conductors pressed into a single wire-receiving slot in the contact, and a method for making the contact. The solderless electrical contact comprises a thin, resilient, flat plate having at least one pair of parallel extended legs defining an open-ended wire-receiving slot, the legs being similarly coined along the wire-receiving slot. The coining is progressively deeper into the thickness of the flat plate from the open end of the slot toward the closed end thereof to taper the slot from a width adjacent the open end of the slot of less than the thickness of the flat plate to a lesser width adjacent the closed end of the slot.

The method comprises the steps of stamping out a thin, resilient, flat plate having at least one pair of parallel extended legs defining an open-ended wire-receiving slot with parallel edges, and similarly coining the legs along the wire-receiving slot, the coining being progressively deeper into the thickness of the flat plate from the open end of the slot toward the closed end thereof. The coining tapers the slot from a width adjacent the open end of the slot of less than the thickness of the flat plate to a lesser width adjacent the closed end of the slot.

The present invention permits the slot in the flat plate contact to be easily stamped at a width generally equal to the thickness of the flat plate. The coining then narrows the entire slot as well as providing a taper from the open end of the slot toward the closed end thereof to permit effective electrical connection to two small diameter insulated conductors pressed into the wire-receiving slot.

IN THE DRAWING

The solderless electrical contact 10 comprises a thin resilient flat plate having a pair of parallel extended legs 12 and 13 defining an open-ended wire-receiving slot 15.

Figure 1:
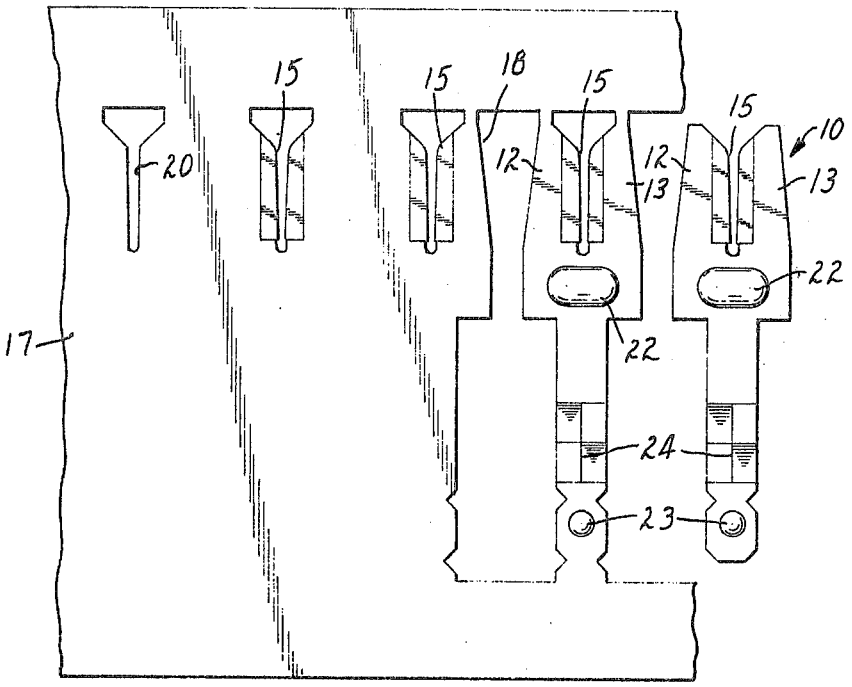
FIG. 1 illustrates the steps of the present invention in forming the solderless electrical contact of the present invention.

The contact 10 may be formed in a progressive die in which the operations illustrated in FIG. 1 are accomplished at successive stations in the die. A strip of sheet metal stock 17 having a thickness as desired for the contact 10 is fed into the die. In the illustrated operation, a parallel sided slot 18 is first stamped from the sheet metal 17 together with material beyond the end of the slot.

Figure 2:
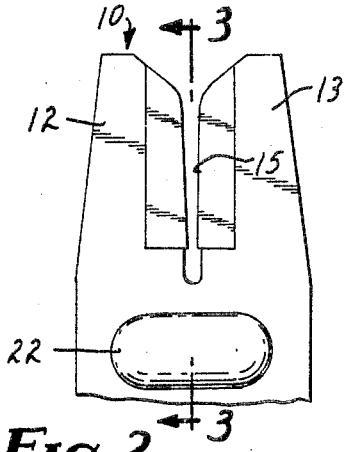
FIG. 2 is an elevation view of the slotted end of the contact.
Figure 3:
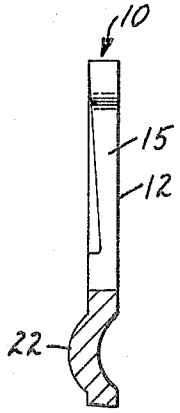
FIG. 3 is a cross-sectional view taken generally along line 3—3 of FIG. 2.
Figure 5:
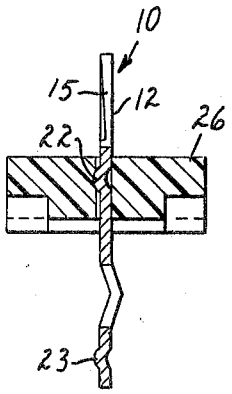
FIG. 5 is a cross-sectional view taken along line 5—5 of FIG. 4.
Figure 4:
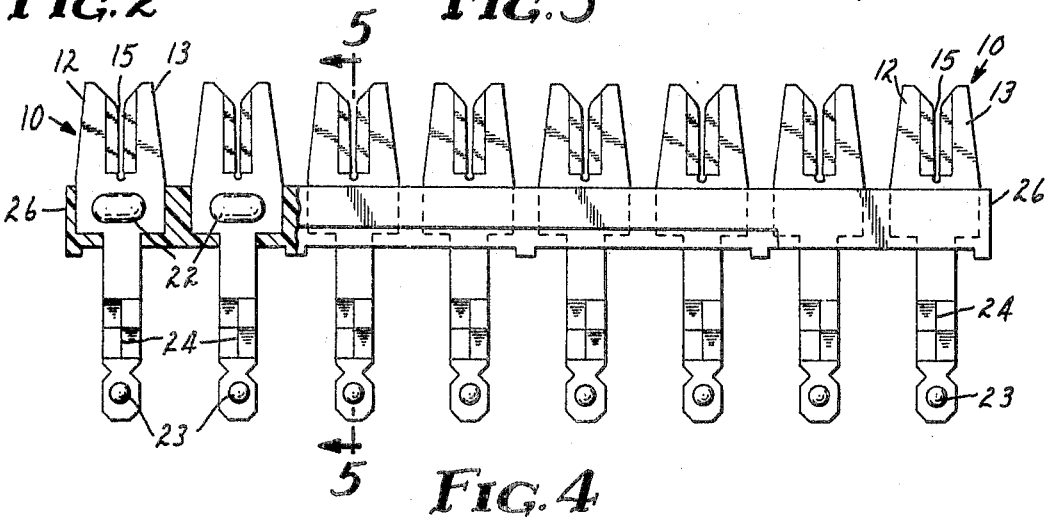
FIG. 4 is an elevation view illustrating a plurality of the contacts retained in an insulating strip.

Following the stamping of the parallel sided slot 18, the area along both sides of the slot are similarly coined to form the desired coined slot 15. The coining is progressively deeper into the thickness of the flat plate from the open end of the slot 15 toward the closed end thereof, as can best be seen in FIG. 3, to taper the slot from a width adjacent the open end of the slot of less than the thickness of the flat plate to a lesser width adjacent the closed end of the slot, as can most clearly be seen in FIG. 2.

In the third step illustrated, the edge profile of adjoining contacts is stamped by excision of the material in the area 20 between them. In the fourth step a projection 22 is stamped in the slotted end of the contact 10, a protrusion 23 is stamped into the opposite free end, a slit 24 is formed in the narrow portion of the contact between the projection 22 and the protrusion 23 and the material on the sides of the slit are deformed in opposite directions. While the operations illustrated in the fourth step would, in normal operation, be performed at multiple stations in the progressive die, they are illustrated as being performed in a single step for purposes of simplicity. Finally, in the fifth illustration step, the remaining connections of the contact to the sheet stock 17 are stamped away to make the finished contact 10.

The illustrated solderless electrical contact 10 is designed for use in electronic circuit prototyping in which, because of space limitations, each contact 10 preferably has only one wire-receiving slot 15, but in which it is highly desirable to be able to connect two small diameter wires at each contact. A plurality of the contacts 10 are inserted into apertures extending through an insulating contact retainer strip 26, each contact 10 being firmly retained in an aperture in the retainer strip 26 by cooperation of its projection 22 with the edgewall of the aperture. The retainer strip 26 with the contacts 10 therein is intended for use in prototyping electronic circuitry on a perforated printed circuit board through which the tails of the contacts 10 are inserted and for connecting to an integrated circuit package through a connector housing on the opposite side of the printed circuit board from the contact retainer strip, as disclosed in co-pending application Ser. No. 689,976, (Attorney's docket No. 29,934), filed concurrently herewith.

Electronic circuit wiring typically employs 30 AWG (0.010 in. diameter) insulated conductors. To make effective spring compression reserve contact to such wires, it has been found that the slot 15 must have a width no greater than about 0.007 inch. It has also been found that it is highly desirable that the contacts 10 be at least 0.010 inch thick to maintain sufficient rigidity in the legs 12 and 13 of the contact 10 to prevent distortion of the legs out of the plane of the contact which would lessen the effectiveness of the electrical connection. Thus, it is preferable that the widest coined portion of the wire-receiving slot 15 adjacent the open end of the slot be less than about three-fourths the thickness of the contact material. To provide a positive taper to the slot 15 from the open end toward the closed end thereof it is then preferable that the narrowest coined portion of the slot adjacent the closed end thereof be less than about one-half of the thickness of the material of the contact. In one specific example for use with 30 AWG insulated conductors, the contact 10 was made of 0.010 inch thick berillium copper, the original parallel edged slot 18 was stamped to 0.009 inch in width and it was coined to a width of 0.006 inch at the open end down to 0.003 inch at the narrowest coined portion of the wire-receiving slot 15. It was found that effective electrical connection to two 30 AWG insulated conductors could be made with the contact 10 constructed in this manner.

We claim:

1. A solderless electrical contact comprising a thin resilient flat plate having at least one pair of parallel extended legs defining an open-ended wire-receiving slot, said legs being similarly coined along said wire-receiving slot, said coining being progressively deeper into the thickness of said flat plate from the open end of said slot toward the closed end thereof to taper said slot from a width adjacent the open end of said slot of less than the thickness of said flat plate to a lesser width adjacent the closed end of said slot, whereby effective electrical connection can be made to two small diameter insulated conductors pressed into said wire-receiving slot.

2. The solderless electrical connector of claim 1 wherein the width of the widest coined portion of said wire-receiving slot adjacent the open end thereof is less than about three-fourths the thickness of said flat plate and the width of the narrowest coined portion of said wire-receiving slot adjacent the closed end thereof is less than about one-half of the thickness of said flat plate.

3. The solderless electrical contact of claim 1 wherein the width of the narrowest coined portion of said wire-receiving slot adjacent the closed end thereof is about one-half the width of the widest coined portion of said wire-receiving slot adjacent the open end thereof.

4. The solderless electrical contact of claim 3 for use with 30 AWG insulated conductors wherein said flat plate is 0.010 inch thick and said narrowest portion of said wire-receiving slot is 0.003 inch.

5. A method of making a solderless electrical contact comprising:

stamping out a thin resilient flat plate having at least one pair of parallel extended legs defining an open-ended wire-receiving slot with parallel edges, and similarly coining said legs along said wire-receiving slot, said coining being progressively deeper into the thickness of said flat plate from the open end of said slot toward the closed end thereof to taper said slot from a width adjacent the open end of said slot of less than the thickness of said flat plate to a lesser width adjacent the closed end of said slot.

6. The method of claim 5 wherein said step of coining comprises coining to make the width of the widest coined portion of said wire-receiving slot adjacent the open end thereof less than about three fourths the thickness of said flat plate and the width of the narrowest coined portion of said wire-receiving slot adjacent the closed end thereof less than about one-half of the thickness of said flat plate.

7. The method of claim 5 wherein said step of coining comprises coining to make the width of the narrowest coined portion of said wire-receiving slot adjacent the closed end thereof about one-half the width of the widest coined portion of said wire-receiving slot adjacent the open end thereof.

8. The method of claim 7 to make a contact for use with 30 AWG insulated conductors wherein said flat plate is 0.010 inch thick and wherein said step of coining comprises coining to make said narrowest portion of said wire-receiving slot 0.003 inch.

* * * * *